United States Patent [19]

Preuhs

[11] 4,399,951

[45] Aug. 23, 1983

[54] COIL CHANGING DEVICE

[75] Inventor: Hans-Jürgen Preuhs, Willich, Fed. Rep. of Germany

[73] Assignee: W. Schlafhorst & Co., Monchen-Gladbach, Fed. Rep. of Germany

[21] Appl. No.: 210,374

[22] Filed: Nov. 26, 1980

[30] Foreign Application Priority Data

Nov. 28, 1979 [DE] Fed. Rep. of Germany ..... 2947901

[51] Int. Cl.[3] ..... B65H 54/02; B65H 54/42; B65H 67/04

[52] U.S. Cl. ..... 242/18 DD; 242/18 PW; 242/35.5 A

[58] Field of Search ..... 242/18 DD, 18 PW, 18 R, 242/35.5 R, 35.5 A, 35.6 R, 18 A

[56] References Cited

U.S. PATENT DOCUMENTS

| | | | |
|---|---|---|---|
| 3,237,876 | 3/1966 | Franzen | 242/18 PW |
| 3,940,077 | 2/1976 | Ohashi | 242/18 A X |
| 3,948,452 | 4/1976 | Burysek et al. | 242/18 PW X |
| 4,015,786 | 4/1977 | Slavik et al. | 242/18 DD X |
| 4,047,674 | 9/1977 | Kamp | 242/18 DD |
| 4,125,990 | 11/1978 | Stahlecker et al. | 242/18 PW X |
| 4,138,071 | 2/1979 | Schewe | 242/18 PW X |
| 4,154,411 | 5/1979 | Kamp et al. | 242/18 PW X |
| 4,352,466 | 10/1982 | Baumges et al. | 242/18 PW |

FOREIGN PATENT DOCUMENTS

| | | | |
|---|---|---|---|
| 2312609 | 10/1974 | Fed. Rep. of Germany | 242/18 PW |
| 2,701,985 | 7/1978 | Fed. Rep. of Germany | 242/18 PW |

*Primary Examiner*—Stanley N. Gilreath

*Attorney, Agent, or Firm*—Herbert L. Lerner; Laurence A. Greenberg

[57] ABSTRACT

Coil changing device for inserting new coil sleeves into a bobbin frame of a cross-wound bobbin winding device, including a friction wheel drive having at least one friction wheel for frictionally driving the coil sleeve and a support for the at least one friction wheel, the at least one friction wheel having a longitudinal axis and being slideable on the support in direction of the longitudinal axis.

5 Claims, 6 Drawing Figures

COIL CHANGING DEVICE

The invention relates to a coil-changing device including a provision for inserting new coil sleeves into the bobbin frame of a cross-wound bobbin winding device, and having a friction wheel drive with at least one friction wheel for the friction drive of the coil sleeve.

Coil changing devices of this type can travel alongside a winding frame or open end spinning frame on rails for example. They serve the purpose of exchanging wound cheeses or bobbins or coils with new coil sleeves. The new coil sleeve may be a completely empty sleeve, or may be a sleeve which already has some started windings. In many cases, the first windings are wound onto the new coil sleeve during the spool change, right then and there. A friction drive which, for example, is inserted temporarily between the winding roller of the coil winding device and the new coil sleeve which is already in place in the bobbin frame is therefore very helpful in order to drive the new coil sleeve with a reduced number of revolutions for a limited time.

Friction drives in coil changing devices are troublesome, because they obstruct the axial motion of the new coil sleeve, which is required for its installation in the bobbin frame. It is accordingly an object of the invention to provide a coil changing device, which overcomes the hereinafore-mentioned disadvantages of the heretofore-known devices of this general type, and to facilitate the insertion of a new coil sleeve in the bobbin frame of a coil winding machine.

With the foregoing and other objects in view there is provided, in accordance with the invention, a coil changing device for inserting new coil sleeves into a bobbin frame of a cross-wound bobbin winding device, comprising a friction wheel drive having at least one friction wheel for frictionally driving the coil sleeve and a support for the at least one friction wheel, the at least one friction wheel having a longitudinal axis and being slideable on the support in direction of the longitudinal axis.

In accordance with another feature of the invention, the at least one friction wheel includes a short axle, two ball bearings having outer rings and being mutually spaced apart on the short axle, a cylindrical shell being axially movably supported on the outer rings, and an outer friction layer disposed on the cylindrical shell.

In accordance with a further feature of the invention, the at least one friction wheel includes resetting means for supplying a restoring force, the friction wheel being slideably supported against the restoring force.

In accordance with an added feature of the invention, there is provided a shoulder extended radially inwardly from the cylindrical shell between the ball bearings, and a resetting spiral spring disposed between and pushing against the shoulder and one of the ball bearings.

In accordance with a concomitant feature of the invention, there is provided a coil sleeve feeder and a winding roller for the cross-wound bobbin winding device, the friction wheel drive being disposed on the coil sleeve feeder and being driveable by the winding roller.

The advantages gained by the invention are especially that the coil changing operation is accelerated, that the axial friction forces which act on the new coil sleeve during insertion are eliminated, and the force required for inserting the new coil sleeve is reduced.

Furthermore, wear is reduced on the surfaces of the friction wheel of the coil sleeve and on the first windings on the latter, and in some case wear on the winding roller is also reduced.

Other features which are considered as characteristic for the invention are set forth in the appended claims.

Although the invention is illustrated and described herein as embodied in a coil changing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 5:
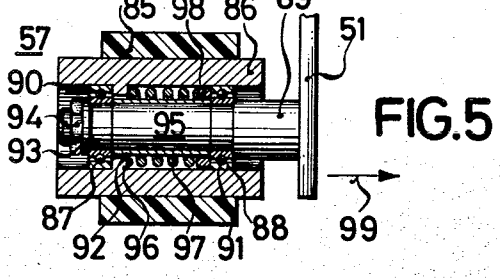
Figure 3:
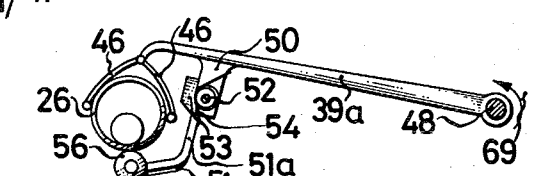
FIG. 3 is a side elevational view of the friction wheel drive.
Figure 3A:
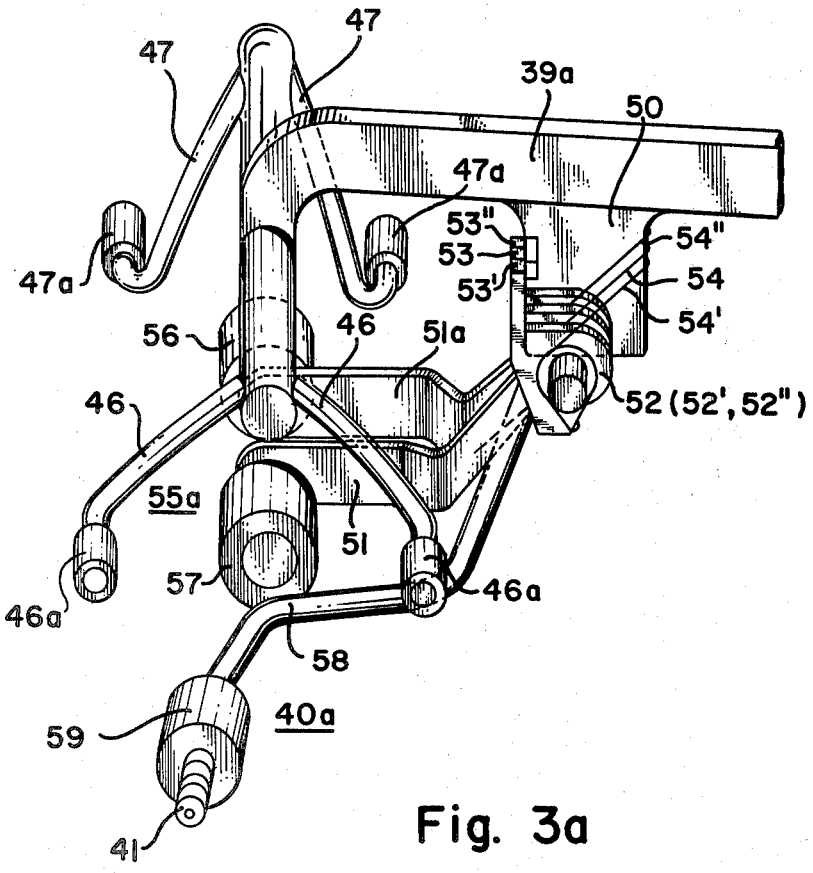
Figure 4:
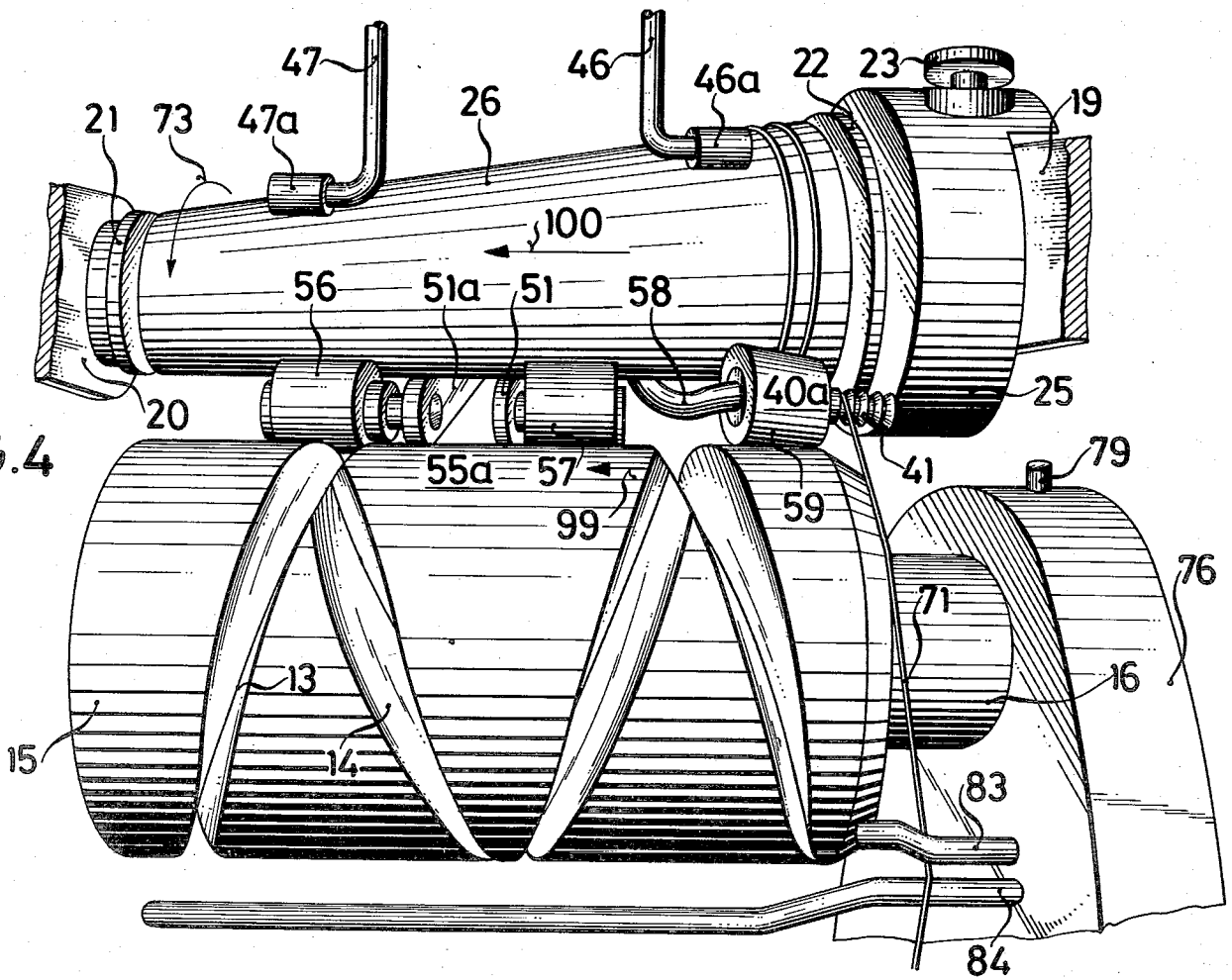

FIG. 3*a* is a fragmentary, enlarged and detailed view of the friction wheel drive of FIG. 3;

FIG. 4 is an enlarged front elevational view of the friction wheel drive; and FIG. 5 is an enlarged longitudinal-sectional view of a drive wheel.

Figure 1:
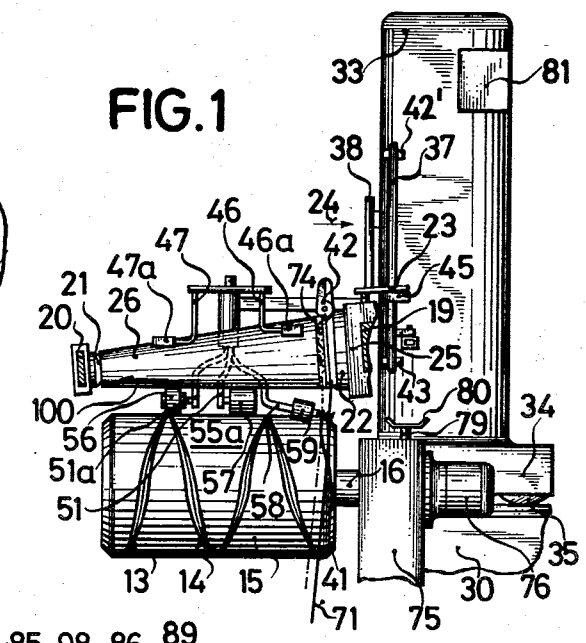
FIG. 1 is a diagrammatic, fragmentary front elevational view of the invention used at a winding device.
Figure 2:
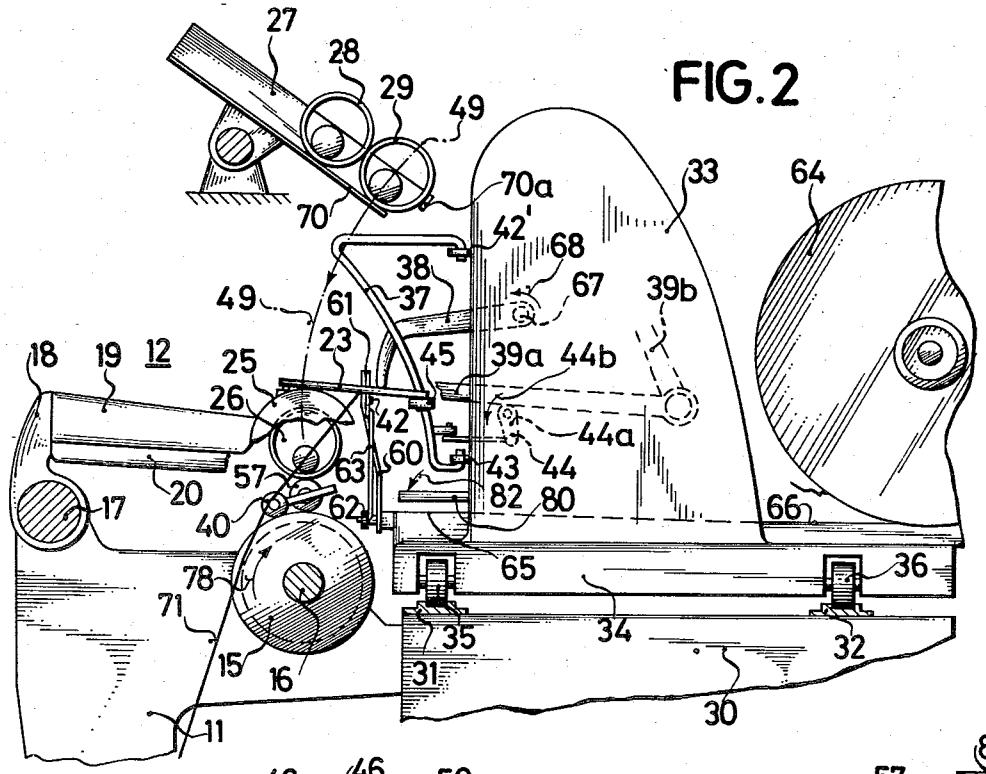
FIG. 2 is a side elevational view of FIG. 1.

Referring now to the figures of the drawing, and first particularly to FIGS. 1 and 2 thereof, it is seen that the machine frame 11 of the cheese or cross-wound bobbin winding device 12 which has a number of simiar winding devices, includes a winding roller 15 with reversed thread grooves 13, 14. The winding roller 15 is sealed on a shaft 16. A bobbin frame 18 which is suspended on a rotatable joint 17 is provided with side arms 19, 20. The side arm 20 has a rotatable sleeve receiver 21, and the side arm 19 has a sleeve receiver 22, which can also be moved in the axial direction by means of a swing lever 23. If the swing lever 23 is moved in the direction of the arrow 24, the sleeve receiver 22 moves in the same direction against the force of a non-illustrated spring which is covered by a housing 25 of the sleeve receiver. When the force acting on the swing lever 23 stops, the spring returns the sleeve receiver back again to the starting position, so that a bobbin sleeve 26 can be accepted and clamped, for example, as shown especially in FIG. 1. The bobbin sleeve 26 can be driven by the winding roller 15, when the bobbin frame 18 is lowered until the bobbin sleeve 26 touches the winding roller 15. The drive is effected by friction. Above the bobbin frame and the winding roller in FIG. 2 there are shown a stationary sleeve magazine 27 containing two empty bobbin sleeves 28 and 29 disposed at the bobbin winding device 12.

Behind the machine frame 11, there are seen rails 31, 32 which are mounted on a sub-structure 30. A travelling coil changing device 33 can be moved along the whole winding machine on the rails. The coil changing device 33 includes a carriage 34 with rollers 35, 36, a frame-opener 37, a frame hold-down device 38, a sleeve feeder 39*a*, a hingeable thread guide 40*a* shown in FIG. 3 and hingeable clamping thread cutting scissors 42. The frame opener 37 can be made to swing in the joints 42', 43 by means of a crank 44 which is seated on a shaft 44*a*, and has a stop 45 that contacts the swing lever 23 from below and thereby prohibits a lowering of the bobbin frame 18 during the coil changing operation. The frame hold-down device 38 serves to hold down the bobbin frame 18 by pushing on the swing-lever 23 from the top. The swing lever 23 is first pressed against the stop 45, and further lowered after the frame opener 37 swings back.

The sleeve feeder 39*a* carries sleeve grippers 46, 47 which are disposed in pairs at the end thereof. The grippers 46, 47 carry the rollers 46*a*, 47*a*, respectively, at their ends as shown in FIG. 3*a* and FIG. 4. The sleeve grippers can be moved in a circular path 49 by rotation of a shaft 48. The sleeve feeder 39*a* has an arm 50 to which three roller-holders 51, 51*a*, 58 are fastened by means of three joints 52, 52″, 52′, respectively. In the rest position, a stop 53 which is attached to the roller-holder 51 presses against the arm 50 by the action of a bent spring 54. The roller holders 51*a* and 58 are also correspondingly provided with stops 53″, 53′ which are pressed against the arm 50 by springs 54″, 54′, respectively, in the rest position. The roller holder 51 carries a friction wheel 57, and the roller holder 51*a* carries a friction wheel 56. The roller-holder 58 carries the aforementioned thread guide 40*a* including a friction wheel 59 and a roller 41. The roller holders and the friction wheels together form a friction wheel drive designated with reference numeral 55*a*.

FIG. 5 represents a longitudinal section through the friction wheel 57, as mentioned above. The drawing shows that the friction wheel 57 has a friction layer 85 on the outside or periphery thereof which is disposed on a cylindrical shell 86. The cylindrical shell 86 is axially slideable on the outer rings 87, 88 of two ball bearings 90, 91 which are disposed at a distance from each other on a short axle 89. The two ball bearings are pressed onto the short axle 89 with a spacer busing 92, and secured by a ring 93 and a nut 94.

The arrangement is made in such a way that the friction wheel 57 is axially slideably supported against the restoring force of a resetting device which is designated as a unit with reference numeral 95. The resetting device 95 includes a shoulder 96 at the cylindrical shell 86 which extends into the space between the two ball bearings, and the actual resetting device in the form of a spiral spring 97 which pushes at one end thereof against the shoulder 96, and at the other side over an intermediate ring 98 against the ball bearing 91.

FIG. 5 shows the rest position. For example, if the short axle 89 is held fixed, and the friction wheel 57 is moved in the direction of the arrow 99, the inside of the shell 86 slides on the outer rings of the two ball bearings 90, 91. If the friction wheel 57 is then released again, the resetting device 95 effects the resetting of the drive wheel to the position shown in FIG. 5.

The drawings of FIG. 1 to FIG. 3 show that the friction wheel drive 55*a* with its roller-holders is disposed at the sleeve feeder 39*a*, and can be driven by the winding roller 15 of the bobbin winding device 12.

During the swing motion of the sleeve feeder 39*a* from the top down, the bobbin sleeve 26 is supported from below by the friction wheel 57 which is in spring-loaded contact therewith. In contrast, the friction-wheel 56 maintains a small distance from the bobbin sleeve 26. The friction wheel 59 carries the roller 41, which is provided with a worm-like screw thread. The guide rods 83, 84 shown in FIG. 4 serve for guiding the thread 71, and also for forming a thread reserve. The clamping thread-cutting scissors or shears 42 are fastened at the holder 60. The movable knife 61 of the shears 42 can be opened and closed with a crank 62 by means of the rod 63. A controlled reversing drive 75 which drives the shaft 16 is provided for the winding roller 15. The reversing drive 75 itself may be driven by a drive motor 76.

The three friction wheels 56, 57, 59 can be driven by the winding roller 15 as soon as the roller holders have moved the friction wheels between the winding roller 15 and the bobbin sleeve 26, as shown in the drawing of FIGS. 1, 2 and 4. During the phase when the thread reserve 74 is produced, the reversing drive 75 is shifted, so that the shaft 16 is driven with a reduced number of revolutions in a direction opposite to its direction during operation which is marked by the curved arrow 78 in FIG. 2. For this purpose, the reversing drive 75 is provided with a shifter 79 which can be operated by a shifter-rail 80 that is fastened to the coil changing device 33. Furthermore, at the coil changing device 33 there is shown a programmer designated as a whole with reference numeral 81. The programmer controls all machine functions and operational steps with a program as will be further explained hereinbelow.

When the travelling coil changing device 33 stops at the bobbin winding device 12 for a coil change, the shifter-rail 80 lowers itself onto the shifter 79 in the direction of the arrow 82 in FIG. 2, whereby the winding roller 15 is shifted to a reduced number of revolutions per minute in a direction opposite to the operational direction indicated by the arrow 78, through the use of the reversing drive 75. In the rest position the sleeve feeder 39*a* is in the position 39*b* shown in FIG. 2.

When a new coil sleeve is to be placed into the bobbin frame 18, first the crank 44 is turned against the direction of arrow 44*b*, so that the frame opener 37 swings against the swing-lever 23 in the direction of the arrow 24 in FIG. 1, and the sleeve receiver 22 is therefore retracted and the bobbin frame 18 is opened. The finished, wound take-up spool 64 therefore rolls over a roll-surface 65 onto a deposition surface of the coil changing device 33. At this point it is possible to use an auxiliary coil ejector which is not shown. Meanwhile, the thread 71, which is brought up from the bottom and is at first still held by the clamping scissors 42 is then severed from the take-up coil 64 by operating the crank 62, so that the thread end is still clamped.

Meanwhile the shaft 67 of the frame hold-down device 38 is rotated in the direction of the arrow 68 so that the frame hold-down device 38 presses elastically against the swing lever 23 from the top. The swing lever 23 thereby comes in contact with the stop 45 of the frame opener 37. The bobbin frame 18 is thereby arrested in the position shown in FIG. 2. This is a position in which the coil sleeve 26 does not yet lie on the winding roller 15.

At that moment, the shaft 48 of the sleeve feeder 39*a* is rotated in the direction of the arrow 69. The sleeve grippers 46, 47 thereby lower themselves from the top and from the right onto the coil sleeve which is in the lowest position in the coil magazine 27, grip that coil sleeve so that the roller holders 51, 51*a*, 58 turn elastically out of the way, open the spring door 70 of the coil magazine 27, and move downward with the coil sleeve on the circular path 49.

The spring door 70 closes itself automatically by spring action, while at the same time the coil sleeves 29 and 28 slide downward against a stop 70*a*. The friction wheels 56, 57 and 59 also elastically move aside from each obstacle by means of the joints 52 during these operational steps. During the coil transport, the friction wheel 57 supports the coil sleeve from the bottom, while the friction wheel 56 is so supported that it keeps a distance from the coil sleeve, and only comes in contact with the coil sleeve when the latter is clamped in the bobbin frame.

In the lower end position the sleeve feeder 39*a* is finally positioned in such a way that the transported coil sleeve 26 lies at the height of the sleeve receiver 21 and 22, as shown in FIG. 1.

At this point, the shaft 44*a* is rotated several degrees in the direction of the arrow 44*b*, whereby the frame opener 37 swings back against the direction of the arrow 24 by a spring force. The swing levers 23 therefore remain in contact with the stop 45. Then, by spring action, the sleeve receiver 22 positions itself against the rim of the coil sleeve 26. At this moment, the shaft 48 is moved a small amount against the direction of the arrow 69, so that the rollers 46*a* and 47*a* loose contact with the coil sleeve 26. The coil sleeve 26 moves under the spring action of the sleeve receiver 22 in the direction of arrow 100 in FIG. 4 until it is securely clamped between the sleeve receivers 21 and 22. The axial motion of the coil sleeve is also provided by the friction wheel 57, while the roller holders 51, 51*a*, and 58 remain at rest, and the cylindrical shell 86 slides along in the direction of the arrow 99 on the ball bearings 90, 91.

During the positioning of the sleeve receiver 22 against the rim of the coil sleeve 26, the thread 71 is securely clamped between the rim of the sleeve and the sleeve receiver.

The frame opener 37 is now further swung back against the direction of the arrow 24, so that the swing lever 23 looses its contact on the stop 45. The swing lever 23 and with it the bobbin frame 18 are therefore rapidly hinged onto the winding roller 15 by the action of the frame hold-down device 38, so that not only the friction wheel 56 comes in contact with the winding roller 15, but the whole friction wheel drive 55*a*, and all friction wheels start to rotate by friction, after the winding roller 15 rotates. Meanwhile, the thread 71 moves into the worm windings or grooves of the roller 41 which leads it away from the rim of the coil sleeve 26, so that a thread reserve 74 is created on the coil sleeve 26. This phase of producing the thread reserve is especially clearly shown in FIG. 4. The sleeve feeder remains in this position for a predetermined time span, until the thread reserve is finished. As already mentioned and indicated in FIG. 4, the sleeve grippers 46, 47 and their rollers 46*a*, 47*a* have moved slightly away from the coil sleeve 26. The coil sleeve 26 is rotated by the friction wheels 56, 57 in the direction of the arrow 73, whereby the thread 71 is wound up to form the afore-mentioned thread reserve 74.

After a predetermined time span, the reversing drive 75 is braked first, and the winding roller 15 is brought to a stop. Then, the shaft 48 is turned against the direction of arrow 69 so far that the sleeve feeder 39*a*, together with the friction wheel drive, have again resumed their starting position 39*b*. The sleeve grippers 46, 47 therefore swing on the circular path 49 through the region of the sleeve magazine 27, whereby the coil sleeves in the magazine move upward, out of the way. The spring loaded roller holders 51, 51*a*, and 58 permit the easy retraction of the friction wheels from their operating positions. Finally, the shifting-rail 80 is lifted, so that the reversing drive is shifted to normal operation, while the coil sleeve 26 simultaneously positions itself against the winding roller 15 under the weight of the bobbin frame 18. The normal winding operation can now resume again, after the thread 71 easily positions itself in one of the reversed thread grooves of the winding roller 15.

The correct sequence and timing of the hereinafore-described work-steps is controlled by the programmer 81, a motor driven control mechanism with cam discs, or by other means in a known manner.

In a somewhat different embodiment of the invention, all three drive rollers are constructed similar to the drawing of FIG. 5. It can also be advantageous to provide the capability for the cylindrical shell 86 to slide and move away to both sides. In this case, there is more freedom of constructing and forming the sleeve feeder. It is thereby important to make the axial movability of the drive wheel effective when inserting the sleeves, and/or when starting the friction wheel drive.

There are claimed:

1. Coil changing device, comprising a cross-wound bobbin winding device having a bobbin frame for receiving coil sleeves to be wound, and a winding roller for driving a coil sleeve in said bobbin frame; and a coil changing device being movable to said bobbin winding device for inserting a new coil sleeve in said bobbin frame, and coil changing device including a friction wheel drive having a support and at least one friction wheel being carried by said support, said at least one friction wheel being driveable by said winding roller for frictionally driving the coil sleeve in turn, and said at least one friction wheel having a longitudinal axis and being slideable on said support in direction of said longitudinal axis for axially moving the coil sleeve when changing coil sleeves.

2. Coil changing device according to claim 1, wherein said at least one friction wheel includes a short axle, two ball bearings having outer rings and being mutually spaced apart on said short axle, a cylindrical shell being axially movably supported on said outer rings, and an outer friction layer disposed on said cylindrical shell.

3. Coil changing device according to claim 1 or 2, wherein said at least one friction wheel includes resetting means for supplying a restoring force, said friction wheel being slideably supported against said restoring force.

4. Coil changing device according to claim 2, including a shoulder extended radially inwardly from said cylindrical shell between said ball bearings, and a resetting spiral spring disposed between and pushing against said shoulder and one of said ball bearings.

5. Coil changing device according to claim 1, 2 or 4, including a coil sleeve feeder, said friction wheel drive being disposed on said coil sleeve feeder.

* * * * *